United States Patent [19]

Mittelstadt

[11] 3,998,486

[45] Dec. 21, 1976

[54] SNOW REMOVER

[75] Inventor: Robert A. Mittelstadt, Burnsville, Minn.

[73] Assignee: Avalanche Company, Burnsville, Minn.

[22] Filed: Nov. 19, 1975

[21] Appl. No.: 633,228

[52] U.S. Cl. ..... 294/54; 37/53; 37/130

[51] Int. Cl.[2] ..... E01H 5/02

[58] Field of Search ..... 294/1 R, 19 R, 49, 54, 294/58; 37/16, 53, 115, 122, 124, 125, 130, 131, 135, 123; 172/189, 612, 767

[56] References Cited

UNITED STATES PATENTS

| | | | |
|---|---|---|---|
| 2,598,952 | 6/1952 | Weingart | 294/54 |
| 2,710,465 | 6/1955 | Timerson | 37/53 |
| 3,007,263 | 11/1961 | Lair | 37/53 |
| 3,024,547 | 3/1962 | Harrison | 294/54 X |
| 3,136,574 | 6/1964 | Pasquale | 294/54 |
| 3,483,643 | 12/1969 | Wenzel | 37/53 |
| 3,486,252 | 12/1969 | Daniels | 294/54 X |
| 3,583,746 | 6/1971 | Lissakers | 294/54 |

FOREIGN PATENTS OR APPLICATIONS

| | | | |
|---|---|---|---|
| 322,165 | 6/1957 | Germany | 37/16 |
| 90,509 | 10/1957 | Norway | 37/53 |

*Primary Examiner*—Johnny D. Cherry
*Attorney, Agent, or Firm*—Paul L. Sjoquist

[57] ABSTRACT

Apparatus is disclosed for removing snow from an inclined surface such as a structural roof, including an elongated flexible sheet having a low surface coefficient of friction, and adapted for sliding along the inclined surface, the sheet being attached to a rod and the rod having an attachment for propelling the apparatus.

19 Claims, 4 Drawing Figures

SNOW REMOVER

BACKGROUND OF THE INVENTION

This invention relates to snow removal apparatus, and particularly to apparatus for removing snow from an inclined plane surface such as is commonly found on residential homes. In northern climates the problem of snow accumulation on rooftops during the winter is significant for several reasons. First, the continual accumulation of snow causes a weight loading problem which, over the period of a winter, may damage structural roof members, and has on occasion caused a roof to collapse. Second, snow accumulation on rooftops is subjected to alternate heating and cooling during winter days and nights, causing moisture to run down the roof surface and accumulate in the form of ice formations along the eaves of the structure. Heat absorbed by the roof surface from inside, and from the sun on the outside of the structure, causes the snow accumulation to begin melting, but no heat is present over projecting eaves, and the water from melted snow refreezes when it runs down to the projecting unheated eave surface. Accumulation of ice formed along the eaves soon causes water to be dammed and thereby prevented from running off the roof, and this water eventually seeps up underneath shingles to leak into the inside of the structure Problems such as described above have been solved in the past indirectly by placing heating elements along the eaves of a structure so as to supplement the melting process and allow water to drain completely from the roof. However, these heating elements are often unsightly and require service, in addition to requiring a continual cost in supplying electrical energy for heating. Other solutions to the problem have resulted in the design of light weight plows and "rakes" on the end of long poles so that the homeowner may either push or pull snow accumulation from the rooftop. These devices either require that the operator climb atop the roof and push snow accumulation away from the crown of the roof and off the edge, or require that the operator stand below the roof and pull snow accumulation toward him. Usually a great deal of effort is required to move snow accumulation in this manner, and the removal operation is time consuming and often dangerous.

SUMMARY OF THE INVENTION

The present invention comprises a rod attached along an edge of a rectangular plastic sheet and supported for easy sliding across a roof surface. The sheet of plastic extends for some distance away from the rod. A means for pushing or pulling the rod and plastic sheet is attached to the rod for purposes of providing a force-transmissive coupling to enable a person to propel the apparatus along the inclined roof surface.

BRIEF DESCRIPTION OF THE DRAWING

A preferred embodiment of the present invention is described herein and is illustrated on the attached drawing in which.

DESCRIPTION OF THE PREFERRED EMBODIMENT

Figure 1:
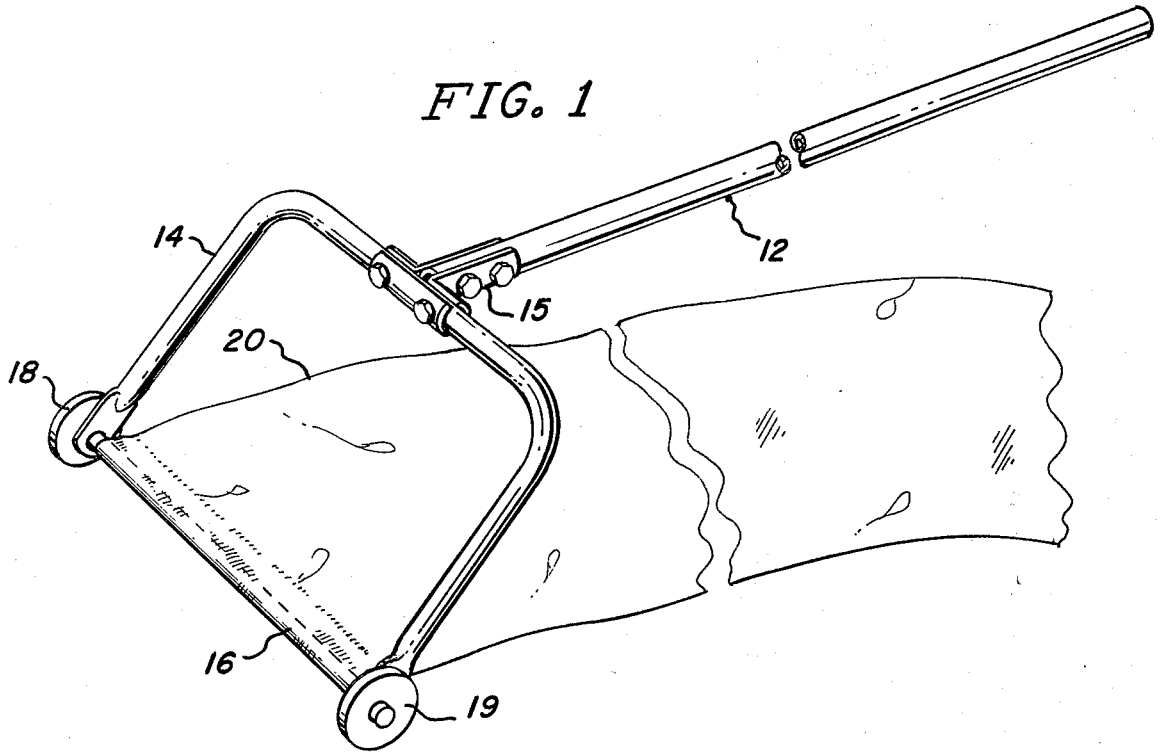
FIG. 1 is an isometric view of a preferred embodiment of the invention.

FIG. 1 shows an isometric view of a preferred embodiment of the invention. An elongated pole or shaft 12 is attached to a U-frame 14 by means of a suitable connecting bracket 15. Shaft 12 may be constructed from an aluminum or fiberglass tube or from any other material adapted to have strength over an elongated length, and U-frame 14 is preferably constructed from a resilient tubular material, although U-frame 14 and bracket 15 may be formed of suitable plastic in a single-piece mold operation. The vertical legs of U-frame 14 may be flattened to reduce the resistance of moving the apparatus through a snow accumulation, by thereby creating more of a knife-edge surface for cutting through the snow. Shaft 12 may be 10 to 20 feet or more in length depending upon the nature and size of the roof the invention is used with and the shaft may be assembled with interlocking or attaching tubular sections.

The legs of U-frame 14 are adapted for inserting therethrough a rod or axle 16 which has wheels 18 and 19 attached at its ends. U-frame 14 is typically 18–30 inches in width, although it may be wider, to provide a snow removal path of reasonable size. Wheels 18 and 19 are freely rotatable and adapted for easy rolling along a roof surface, being typically at least several inches in diameter. Alternately, wheels 18 and 19 could be replaced by a simple pair of runners or other glide surface, so long as the rod or axle 16 is supported for relatively easy sliding over the roof surface.

A flexible sheet 20 is attached around rod 16 over substantially its entire length between the members of U-frame 14. Sheet 20 is preferably formed of a plastic material such as polyethylene, of thickness 0.002 inch – 0.010 inch, and having a length of at least several feet. In a preferred embodiment sheet 20 may be made 10–15 feet long, or longer, to enable the sheet to overhang the lower roof edge as the apparatus is moved upward along the roof surface. The surface of sheet 20 is preferably of a low coefficient of friction, for example less than 0.2, which presents a slippery surface to cause snow to readily slide over the surface of sheet 20. Plastic sheet material is commercially available having a reinforcing filament embedded therein, and this type of plastic sheet material may be used to provide additional strength against tearing of the sheet. In any event axle 16 is preferably removable from U-frame 14 to permit the attachment of a new sheet 20 when excessive wear occurs. Sheet 20 may be attached around rod 16 by sewing, glueing, or thermally bonding according to practices known in the art, but it is advantageous to form such an attachment while leaving an opening for rod 16 which is larger than rod 16 to permit freedom of movement of sheet 20 about rod 16.

Figure 2:
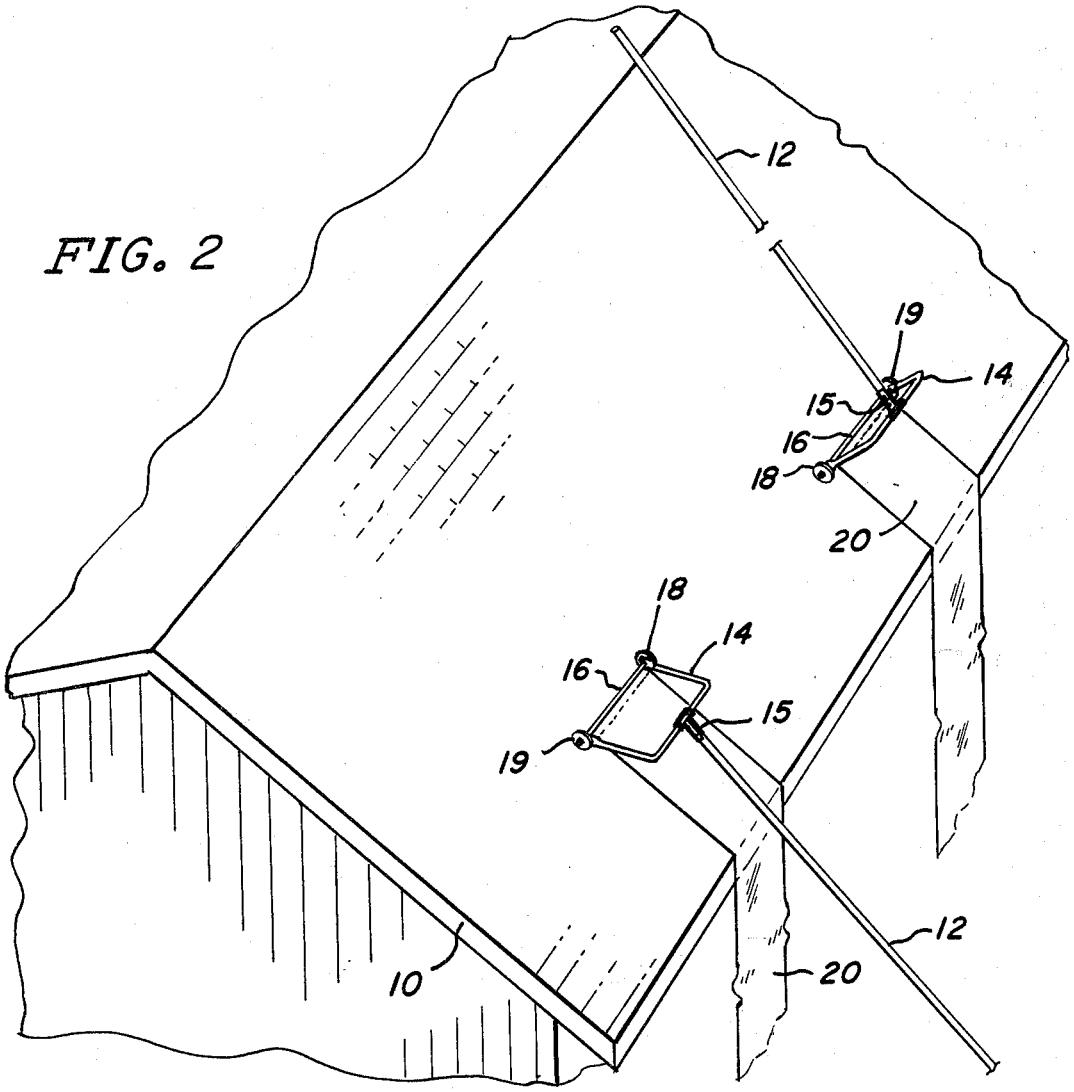
FIG. 2 shows the preferred embodiment on a roof surface.

FIG. 2 shows an isometric view of a roof structure 10 of a type commonly found on residential buildings. Two operational embodiments of the invention are also illustrated. In the first operational embodiment, the elongated pole or shaft 12 extends downwardly to a point below the roof where the operator can grasp it and propel the apparatus upward along the roof surface.

In the alternative operational embodiment shown in FIG. 1, all structural members are identically constructed to that described hereinbefore, the only difference being that sheet 20 is positioned away from the U-frame in an opposite direction. The alternative embodiment therefore enables the apparatus to be propelled by a person standing on the crown of the roof and pulling the apparatus towards him, whereas the first embodiment requires that the operator preferably stand on the ground below the roof and push the apparatus away from him up the roof surface. In either event, if an accumulation of snow exists on the roof surface rod 16 and sheet 20 will undercut the snow accumulation, causing it to settle on sheet 20. Since sheet 20 is selected from materials having very low coefficient of friction, a gravitational sliding force will cause the snow resting on sheet 20 to slide downwardly off the edge of the roof.

Figure 3:
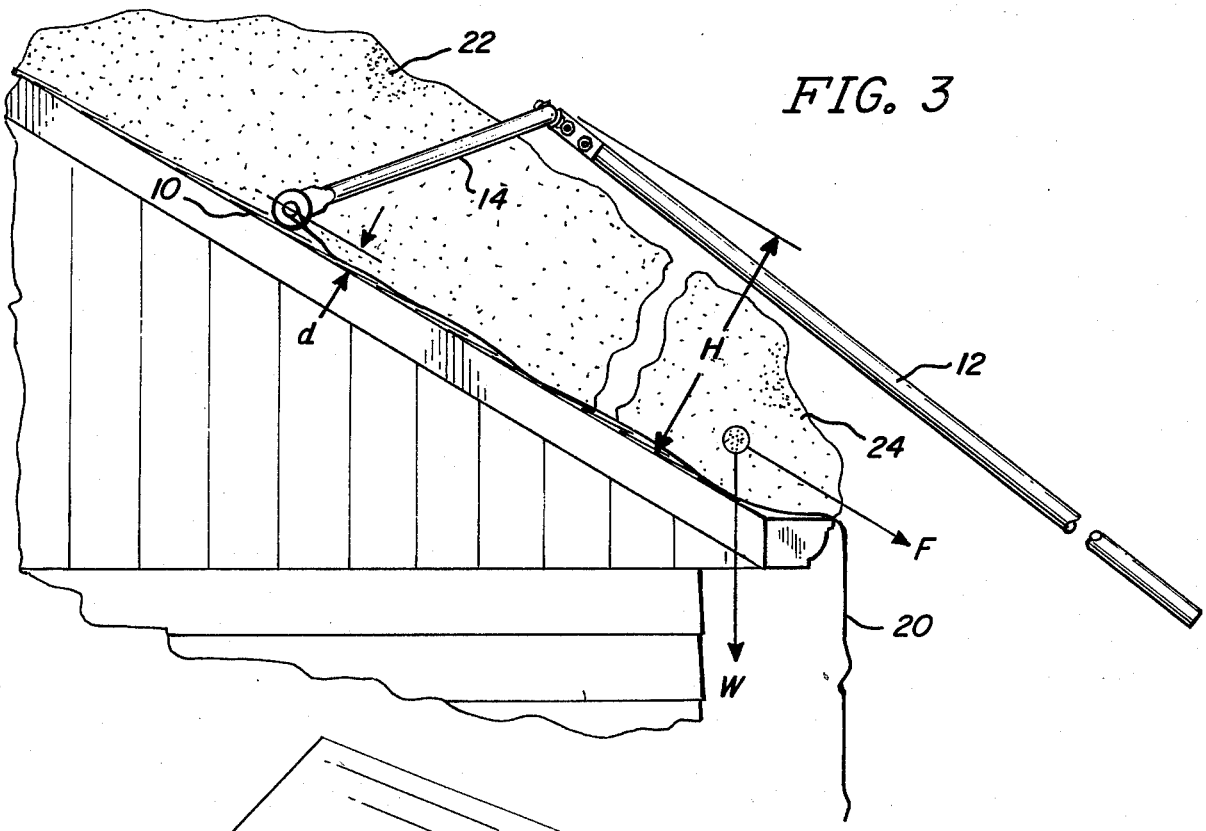
FIG. 3 shows the preferred embodiment in side view.

FIG. 3 illustrates the invention in side view on a roof surface 10. The top of U-frame 14 has a vertical height H above roof surface 10 sufficient to pass over any reasonable snow accumulation depth. A height H of 12 inches has been found satisfactory for most purposes. U-frame 14 is propelled upwardly along roof surface 10, with the wheels rolling along the roof surface, by applying upward force to shaft 12. This causes the rod attached to the wheels to undercut the snow accumulation 22 and to slide sheet 20 under snow accumulation 22. As U-frame 14 is pushed upwardly a snow accumulation fracture 24 occurs, wherein a portion of the accumulated snow breaks away from the snow remaining on the roof surface.

The invention undercuts a snow accumulation at a depth *d* which corresponds to the height of the rod above the roof surface. This height is typically about ½–2 inches and results in a very thin layer of snow accumulation being left on the roof. It has been found that this thin snow layer is of no harmful consequence and is usually dissipated by sublimation, melting or blowing after only a short period of time.

Fractured snow accumulation 24 is subjected to a vertical downward weight force W which has a component F acting downwardly in parallel with the roof surface. Because the coefficient of friction of sheet 20 is very low, the gravitational sliding force F is sufficient to cause the fractured snow accumulation 24 to move along sheet 20 and over the edge of roof surface 10, dropping to the ground. The magnitude of sliding force F is dependent upon the weight of fractured snow accumulation 24 and the pitch of roof surface 10. In practice it has been found readily possible to remove a snow accumulation from roof surfaces that have a pitch of 20°, and it is believed that accumulations may be removed from roof surfaces of even lower pitch angle. For example, if the roof surface 10 were nearly flat, U-frame 14 could be propelled into a portion of the snow accumulation and then lifted from the roof to cause the accumulation trapped on sheet 20 to lift to an elevation sufficient to cause sliding. The lifting of U-frame 14 from the roof in this example may be enhanced by utilizing shaft 12 as a lever, pivoting about a contact point on the roof edge. However, if the invention is to be used in this manner care must be taken to insure that shaft 12 is of sufficient strength to withstand the lifting forces which will be imposed upon it due to such leverage action. It is also possible to lift U-frame 14 upwardly through a snow accumulation and then withdraw shaft 12 backwardly toward the roof edge, thereby trapping a portion of the snow accumulation on sheet 20 and forcing it backwardly over the edge of the roof. This operational approach has the advantage of not subjecting shaft 12 to the bending stresses which would otherwise occur in the leverage operation described above.

Figure 4:
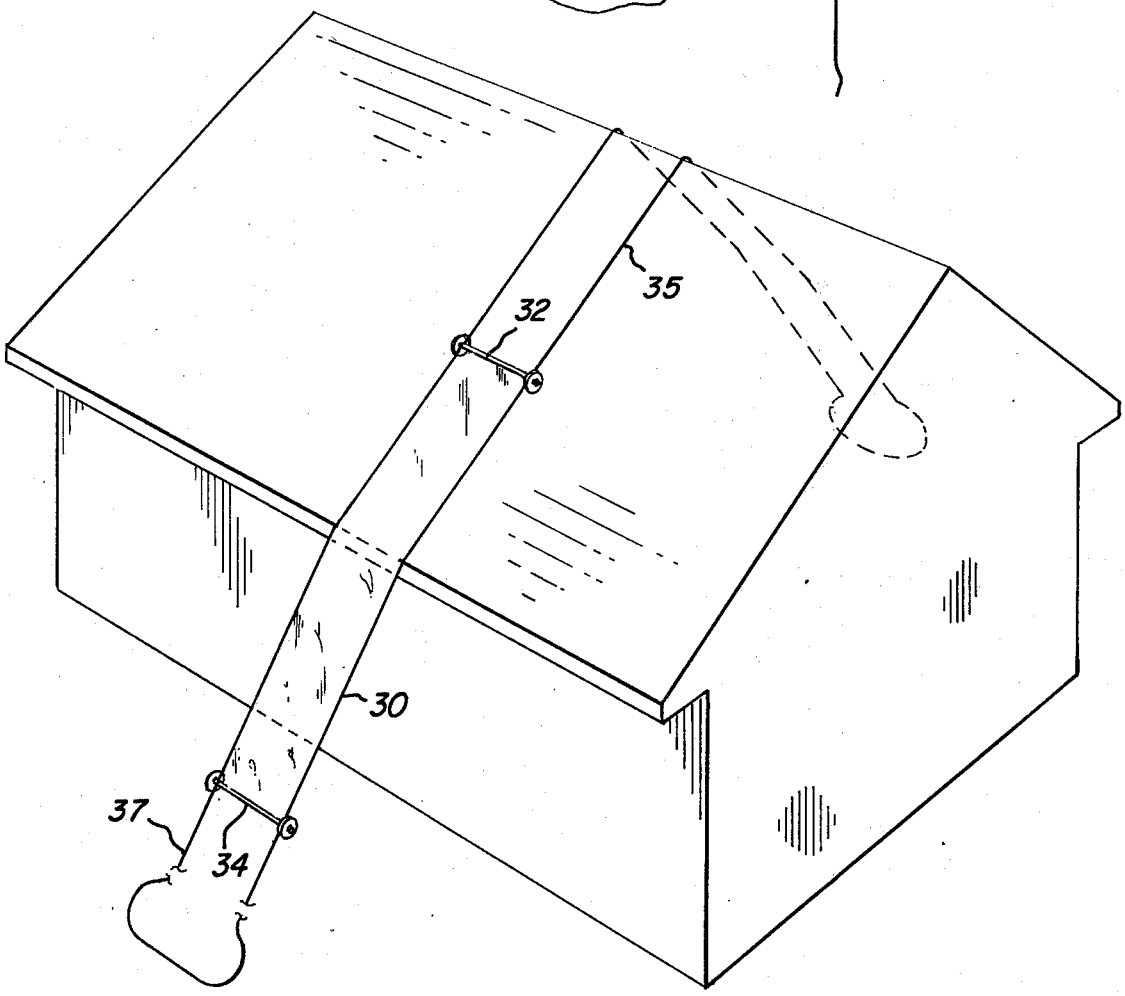
FIG. 4 shows an isometric view of an alternative embodiment of the invention.

FIG. 4 shows an alternative embodiment of the invention wherein the invention may be propelled along a roof surface by means of a rope or cord. In this embodiment, an elongated plastic sheet 30 of a preferable length of about 20 feet has attached at either of its ends rods 32 and 34, each with a pair of wheels. A long cord loop 35 is attached to rod 32, and a second cord loop 37 is attached to rod 34. Loops 35 and 37 are preferably formed in lengths sufficient to be thrown or propelled over the entire roof surface so that they may be grasped from the opposite side of the roof. In this embodiment a person or machine-driven power source pulls cord 35 upwardly along the roof surface, causing rod 32 and sheet 30 to undercut the snow accumulation. Sheet 30 may be propelled over the crown of the roof and down the other side of the roof in this manner, and may be returned by pulling cord loop 37. Loops 35 and 37 therefore enable the sheet 30 to be moved over the entire roof surface and remove all snow from the surface. Of course, obstructions such as chimneys and ventilators will prevent the sheet from removing snow at these locations, but the amount of snow accumulated which remains on the roof surface because of such projections is normally very small.

Although various modifications may be made to either the preferred or alternative embodiments described herein it is believed that the embodiments described herein will provide a satisfactory apparatus under most conditions.

What is claimed is:

1. An apparatus for sliding snow from a roof; comprising a. a rectangular plastic slide having a length dimension substantially longer than its width dimension, said length dimension forming an elongated slide along the surface of said roof which may overhang the edge of said roof;

b. an edge support rod attached along a width dimension edge of said rectangular slide;

c. a U-bracket having snow-cutting legs attached to said edge support rod; and d. an elongated pole attached to said U-bracket in spaced alignment with said plastic slide length dimension.

2. The apparatus of claim 1, further comprising support means attached to said edge support rod for supporting said rod in spaced and slidable relationship to said surface.

3. The apparatus of claim 2 wherein said support means further comprises a pair of wheels.

4. The apparatus of claim 3, wherein said rectangular sheet of plastic material further comprises polyethylene plastic having a surface coefficient of friction of less than 0.2.

5. The apparatus of claim 4, wherein said wheels have diameters of not more than 3 inches.

6. An apparatus for removing snow from a surface, comprising:

a. a rectangular sheet of plastic material having a length dimension substantially longer than its width dimension;

b. an edge support rod attached along each width dimension end of said rectangular sheet;

c. support means attached to each edge support rod for supporting said rod in spaced and slidable relationship to said surface; and d. an elongated rope attached to each of said edge support rods.

7. The apparatus of claim 6 wherein said support means each further comprises a pair of wheels.

8. The apparatus of claim 7, wherein said rectangular sheet of plastic material further comprises polyethylene plastic having a surface coefficient of friction of less than 0.2.

9. The apparatus of claim 8, wherein said wheels have diameters of not more than 3 inches.

10. An apparatus for removing snow from an inclined roof surface, comprising:

a. a U-frame having two substantially vertical and parallel snow cutting arms, and having means for attaching a handle thereto;

b. a snow cutting bar extending between said snow cutting arms;

c. a sheet of flexible slide material attached to said snow cutting bar;

d. transport means, attached to said snow cutting arms, for low-friction travel contact of said frame over said inclined surface; and e. an elongated handle connected at one of its ends to said U-frame means for attaching a handle.

11. The apparatus of claim 10, wherein said transport means further comprises a rotatable wheel attached to each of said frame snow cutting arms.

12. The apparatus of claim 11, wherein said U-frame further comprises a tubular member having flattened arms.

13. The apparatus of claim 12, wherein said wheels are respectively attached proximate the ends of said U-frame flattened arms.

14. An apparatus for removing snow from an inclined roof surface by cutting the snow into rectangular blocks and sliding said snow over the inclined surface, comprising:

a. a sheet of flexible material having a long dimension and a short dimension, and having a smooth texture;

b. an edge support rod attached along a short dimension of said sheet;

c. means for supporting said edge support rod in spaced relationship to said surface; and d. means for propelling said sheet over said inclined surface, attached to said edge support rod, and comprising a frame member having vertical snow cutting edges and an elongated handle attached thereto.

15. The apparatus of claim 14, wherein said means for supporting said edge support rod further comprises wheels attached to said edge support rod.

16. The apparatus of claim 15, wherein said frame member further comprises a U-frame having its ends attached to said edge support rod.

17. An apparatus for removing snow from a roof surface, comprising:

a. a sheet of flexible material having a long dimension for forming a slide along said roof surface and a short dimension for undercutting said snow, and having a surface coefficient of friction of less than 0.2;

b. an edge support rod attached along a short dimension edge of said sheet;

c. a pair of wheels attached to said edge support rod;

d. a U-bracket having snow-cutting legs attached proximate the ends of said edge support rod adjacent said wheels; and e. an elongated pole attached to said U-bracket in alignment with said sheet long dimension and in approximate perpendicular relationship to said U-bracket.

18. An apparatus for removing snow from a roof surface, comprising:

a. a sheet of flexible material having a long dimension and a short dimension, and having a smooth texture;

b. an edge support rod attached along a short side of said sheet and a second edge support rod attached along a second short side of said sheet;

c. a pair of wheels attached to each of said edge support rods; and d. a cord loop attached to each of said edge support rods.

19. An apparatus for removing snow from a roof surface, comprising:

a. a sheet of flexible material having a long dimension and a short dimension, and having a surface coefficient of friction of less than 0.2;

b. an edge support rod attached along a short side of said sheet, and a second edge support rod attached along a second short side of said sheet;

c. a pair of wheels attached to each of said edge support rods; and d. a cord loop attached to each of said edge support rods.

* * * * *